US006402276B1

(12) United States Patent
King

(10) Patent No.: US 6,402,276 B1
(45) Date of Patent: Jun. 11, 2002

(54) DRAWER GUIDE ASSEMBLY AND FURNITURE INCORPORATING SAME

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 0 days.

(21) Appl. No.: 09/799,154

(22) Filed: Mar. 5, 2001

Related U.S. Application Data

(60) Provisional application No. 60/186,977, filed on Mar. 6, 2000.

(51) Int. Cl.[7] ..... A47B 88/00

(52) U.S. Cl. ..... 312/334.7; 312/334.5

(58) Field of Search ..... 312/330.1, 334.1, 312/334.5, 334.7, 334.8, 334.12, 349, 350, 351; 403/187, 188, 192

(56) References Cited

U.S. PATENT DOCUMENTS

| | | | | |
|---|---|---|---|---|
| RE30,717 | E | | 8/1981 | Dargene |
| 4,517,706 | A | | 5/1985 | Lautenschläger et al. |
| 4,615,072 | A | | 10/1986 | Lautenschläger et al. |
| 4,698,877 | A | | 10/1987 | Lautenschläger, Jr. et al. |
| 4,703,539 | A | | 11/1987 | Lautenschläger, Jr. et al. |
| 4,704,766 | A | | 11/1987 | Almestad |
| 4,799,290 | A | | 1/1989 | Lautenschläger, Jr. |
| 4,856,141 | A | | 8/1989 | Sassenberg |
| 4,976,006 | A | | 12/1990 | Lautenschläger et al. |
| 5,052,077 | A | | 10/1991 | Lautenschläger et al. |
| 5,067,200 | A | | 11/1991 | Stowell et al. |
| 5,103,532 | A | | 4/1992 | Youngdale et al. |
| 5,108,165 | A | | 4/1992 | Rorke et al. ..... 312/322 |
| 5,327,616 | A | | 7/1994 | Lautenschläger |
| 5,375,297 | A | | 12/1994 | Lautenschläger et al. |
| 5,392,493 | A | | 2/1995 | Youngdale |
| 5,457,867 | A | * | 10/1995 | Mayberry et al. ..... 312/350 X |
| 5,511,287 | A | | 4/1996 | Lautenschläger et al. |
| 5,577,296 | A | | 11/1996 | Grass |
| RE36,213 | E | | 6/1999 | Lautenschläger et al. |
| 6,106,185 | A | * | 8/2000 | Isele et al. ..... 312/334.5 X |

FOREIGN PATENT DOCUMENTS

| | | |
|---|---|---|
| DE | 4405349 | 8/1995 |

OTHER PUBLICATIONS

P. 49 of the 1998 Charles McMurray Catalog.

* cited by examiner

*Primary Examiner*—James O. Hansen
(74) *Attorney, Agent, or Firm*—Thomas R. Lampe

(57) ABSTRACT

A mounting bracket of a drawer guide assembly is connected to furniture structure through the use of a fastener member positioned in a recess and communicating slot formed in the furniture structure. A threaded member extends through an aperture formed in the mounting bracket and into the slot and is threadedly engaged with the fastener member to clamp a portion of the furniture structure between the mounting bracket and the fastener member.

15 Claims, 3 Drawing Sheets

DRAWER GUIDE ASSEMBLY AND FURNITURE INCORPORATING SAME

This invention is based on and claims the benefits of U.S. Provisional Application Serial No. 60/186,977, filed Mar. 6, 2000.

TECHNICAL FIELD

This invention relates generally to drawer guides for cabinets and other types of furniture and, more specifically, to a system for attaching a drawer guide assembly to a cabinet or other piece of furniture without the use of wood screws.

BACKGROUND OF THE INVENTION

Mass produced furniture, including cabinets, has become commonplace. While a segment of the furniture business still caters to niche customers willing to pay for hand-crafted furniture, the majority of consumers now purchase low-cost furniture, manufactured in large quantities, and often sold through large outlets and home improvement stores.

Much of the mass produced furniture sold currently is manufactured from particle board or multi-density fiber (MDF). Particle board is comprised of wood chips mixed with glue-like binders and pressed into desired shapes to form a composite board. MDF is comprised of fine sawdust mixed with binders and extruded into composite boards. Both particle board and MDF can be laminated with various layers or with washable, scratch-proof exterior surfaces. These exterior surfaces give any furniture constructed therefrom the exterior appearance of fine wood or laminate, even though composite MDF or particle board is disposed underneath.

A problem arises when common wood screws are used to fasten furniture hardware, such as drawer guides and hinges, to MDF or particle board. It has been found that screws often work loose from thinner widths of composite materials and fail to hold the hardware in place. For this reason, ¾ inch MDF or particle board is typically used in the manufacture of furniture of this type so that longer wood screws can be used which will remain in place over the life of the furniture product. However, this limitation means that thinner widths of composite materials cannot be used. The cost savings advantages of using thinner materials to manufacture furniture are obvious, but the use of less material in furniture manufacture also results in savings to the environment in terms of the amount of wood products used. Therefore, a need exists for furniture hardware applications which allow less material to be used in the manufacture of the article of furniture.

A number of arrangements have been devised for attaching hardware to cabinets, some of which employ a metal fastener disposed in a recess of a cabinet wall and threadedly engaged with a bolt to attach the hardware to the cabinet.

The following patents and materials are believed to be representative of the current state of the prior art in this field: U.S. Pat. No. 5,067,200, issued Nov. 26, 1991, U.S. Pat. No. 4,703,539, issued Nov. 3, 1987, U.S. Pat. No. 5,511,287, issued Apr. 30, 1996, U.S. Pat. No. 4,799,290,issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. Re. 36,213, issued Jun. 1, 1999, U.S. Pat. No. Re. 30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is disclosed in German Offenlegungsschrift DE 4405349A1. Other hinges of some degree of relevance are shown on page 49 of the 1998 Charles McMurray Catalog.

The above-identified prior art does not describe or suggest the combination of structural elements and interrelationships therebetween disclosed and claimed herein.

DISCLOSURE OF INVENTION

The present invention relates to a system wherein a drawer guide assembly is fastened to a piece of furniture without employing wood screws. The invention is particularly useful in connection with furniture made from MDF or particle board due to the elimination of the need for employing wood screws. This allows use of thinner MDF or particle board. The apparatus is characterized by the fact that installation can be quickly and readily effected. Furthermore, a strong interconnection is established between the furniture structure and the drawer guide assembly, resisting structural failure resulting from application of external forces to the assembly.

The invention is directed to a combination including furniture structure having spaced, opposed structure surfaces, the furniture structure defining an opening, a recess communicating with the opening and located between the structure surfaces and a slot extending into the furniture structure from one of the structure surfaces. The slot communicates with the recess, extends therealong and has a vertical dimension less than the vertical dimension of the recess.

A drawer guide assembly extends along the furniture structure adjacent to one of the structure surfaces and includes a mounting bracket positioned over the slot. The mounting bracket defines an aperture.

Fastener means fastens the mounting bracket to the furniture structure. The fastener means comprises a threaded member extending through the aperture of the mounting bracket and into the slot and a fastener member disposed in the recess and threadedly engaged with the threaded member. A portion of the furniture structure adjoining the slot is clampingly engaged between the mounting bracket and the fastener member.

The fastener member includes a fastener plate bearing against the portion of the furniture structure and a threaded boss projecting from the fastener plate into the slot.

Other features, advantages, and objects of the present invention will become apparent with reference to the following description and accompanying drawings.

MODES FOR CARRYING OUT THE INVENTION

Figure 3:
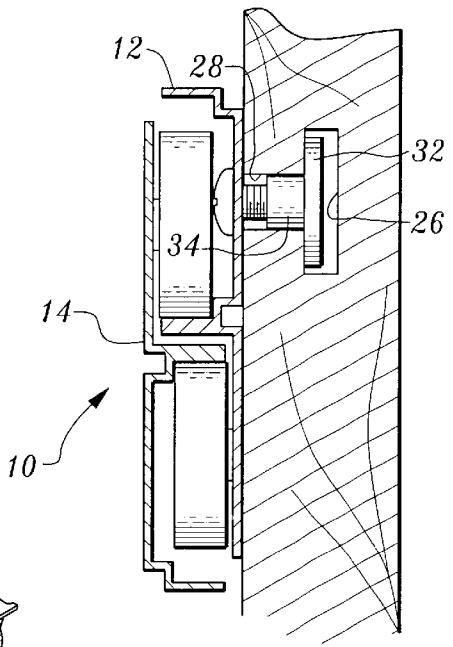
FIG. 3 is an enlarged, cross-sectional view illustrating a portion of the cabinet wall with the drawer guide assembly installed thereon and fastened thereto.
Figure 1:
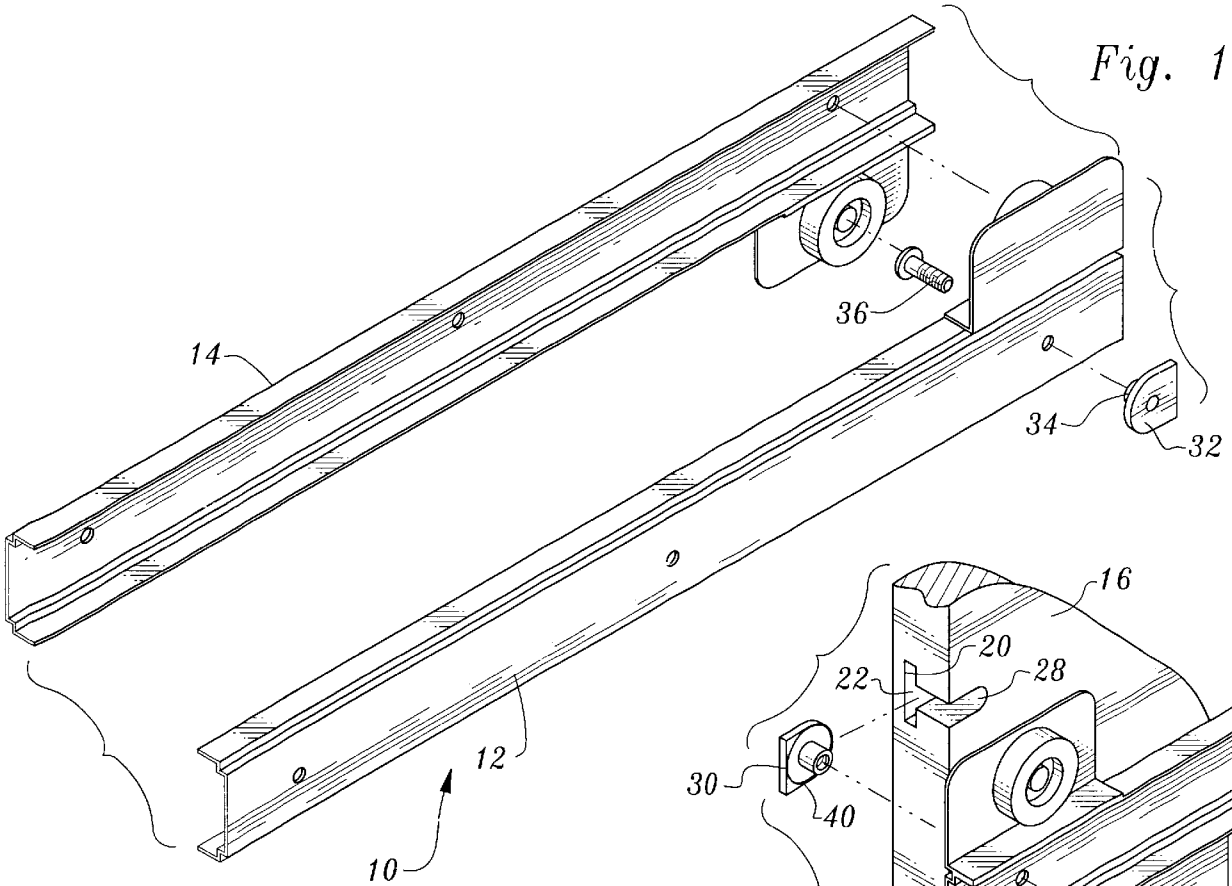
FIG. 1 is an exploded, perspective view of selected components of the invention including drawer guide assembly structure and fastener components for attaching the assembly to furniture structure.
Figure 2:
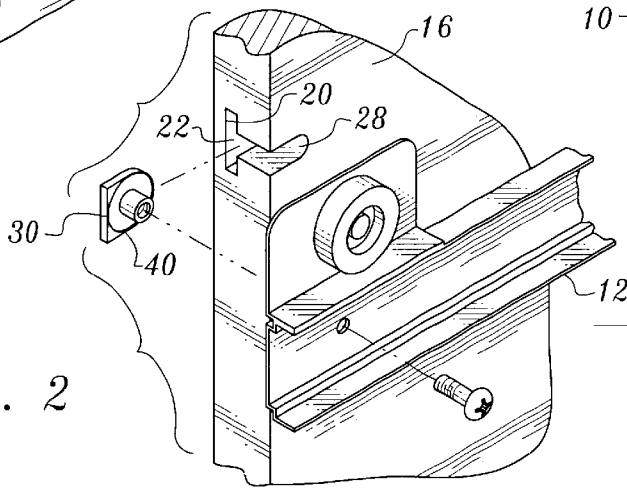
FIG. 2 is a frontal, perspective view illustrating installation of the drawer guide assembly mounting bracket on a cabinet wall.

Referring now to FIGS. 1–4, a drawer guide assembly 10 includes, as is conventional, a drawer guide mounting bracket 12 and a roller guide 14. The mounting bracket 12 is mounted so that it extends along the inner surface of a wall 16, in the arrangement illustrated, a cabinet wall. The roller guide 14 is attached to a drawer (not shown) and is inserted into the mounting bracket 12 in a well known manner. The roller guide 14 and the attached drawer then roll relative to the mounting bracket 12.

In this illustrated embodiment, an opening 20 is formed in each cabinet wall end, the openings 20 each having a T-shaped configuration and including a vertically oriented opening component 22 and an intersecting horizontally oriented opening component 24.

At each cabinet wall end, an elongated recess 26 extends from and communicates with the generally vertically oriented opening component 22. The recess extends a predetermined distance into the wall 16.

The horizontally oriented opening component 24 communicates with a slot 28 extending into the cabinet wall. Slot 28 extends along the recess 26 and is in communication therewith. The slot 28 has a vertical dimension less than the vertical dimension of the recess and communicates with the interior surface of the cabinet wall.

Fastener means fastens the mounting bracket to the cabinet wall at each end of the cabinet wall. The fastener means positioned at each end of the mounting bracket includes a fastener member 30 comprised of a fastener plate 32 and an internally threaded boss 34 affixed to the fastener plate and projecting outwardly therefrom. Each boss 34 is threadedly engaged with a bolt 36 (threaded number), each bolt passing through an aperture 38 in the mounting bracket. A rib 40 is formed on each plate 32 and is spaced from and surrounds the threaded boss (see FIG. 2). When the fastener member and the bolt are tightened to clampingly engage a portion of the cabinet wall adjoining the slot 28, the rib 40 will "bite" into the material of the wall to establish a firm and stable connection.

The size of each opening 20 is such as to allow the fastener member to enter the recess and slot through the opening. That is, the vertically oriented opening component 22 is of sufficient size to allow selective entry of the fastener plate into the recess 26 or exit of the fastener plate from the recess. The horizontally oriented opening component 24 allows selective entry of the threaded boss into the slot 28 or exit of the threaded boss from the slot.

Figures 4, 5:
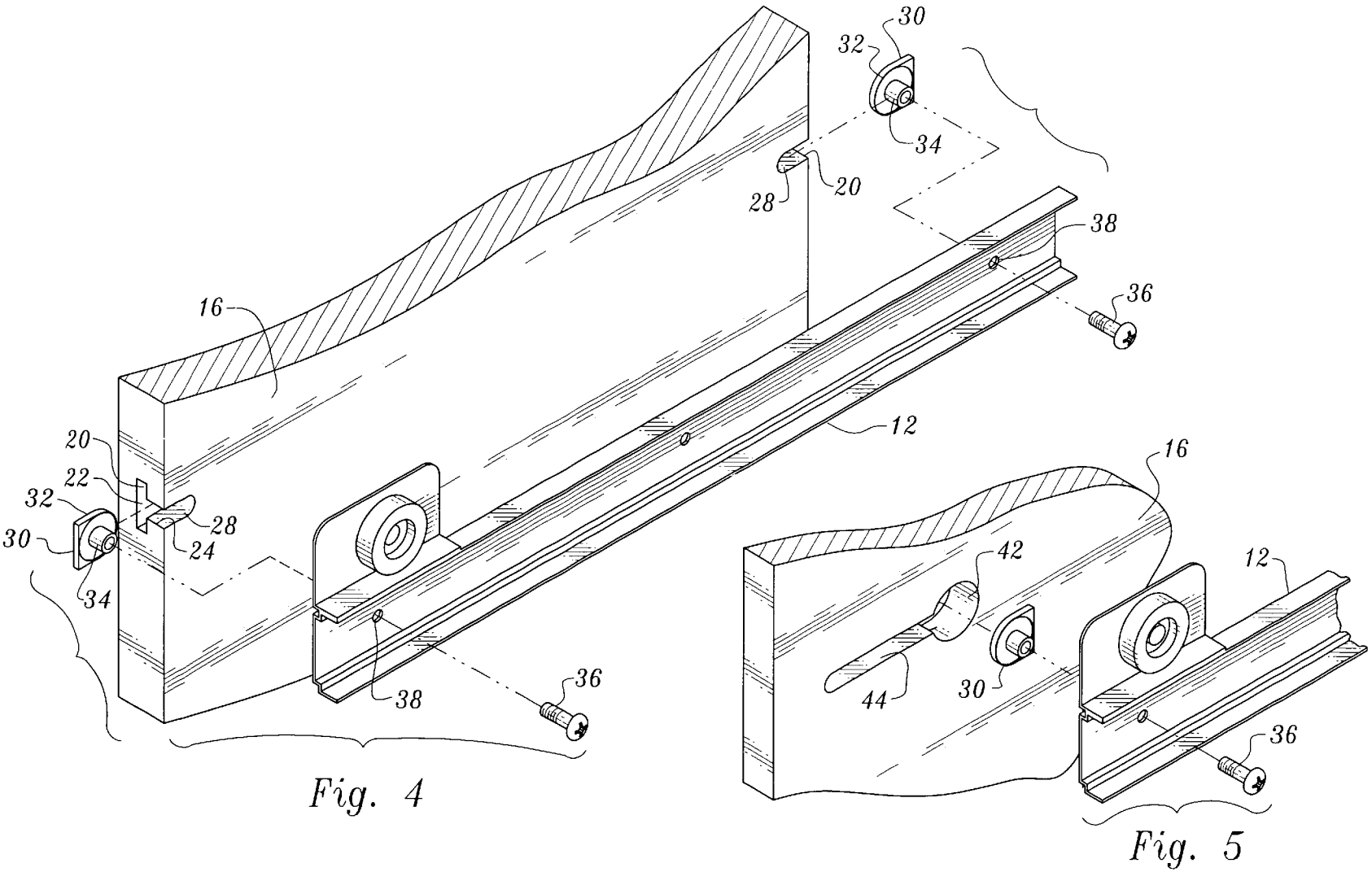
FIG. 4 is an exploded, perspective view illustrating the drawer guide assembly mounting bracket prior to attachment thereof to a cabinet wall at two ends of the cabinet wall.
FIG. 5 is a perspective view illustrating a portion of the drawer guide assembly mounting bracket prior to attachment thereof to a cabinet wall, at a different location on the cabinet wall than shown FIGS. 1 - 4.

FIG. 5 illustrates a somewhat different arrangement wherein the recess and slot do not extend inwardly from an opening formed at the cabinet wall end. In this arrangement, an opening 42 is formed in and projects inwardly from the surface of cabinet wall 16 at a location spaced from the cabinet wall end. The opening 42 is large enough to receive fastener member 30. A slot 44 and a recess communicating with the slot and formed in the cabinet wall in the manner of recess 26 described above communicate with the opening 42 so that the fastener member 30 can be slid into position in the recess and slot from the opening 42 prior to attachment of the fastener member 30 to bolt 36 passing through the mounting bracket 12.

Figure 6:
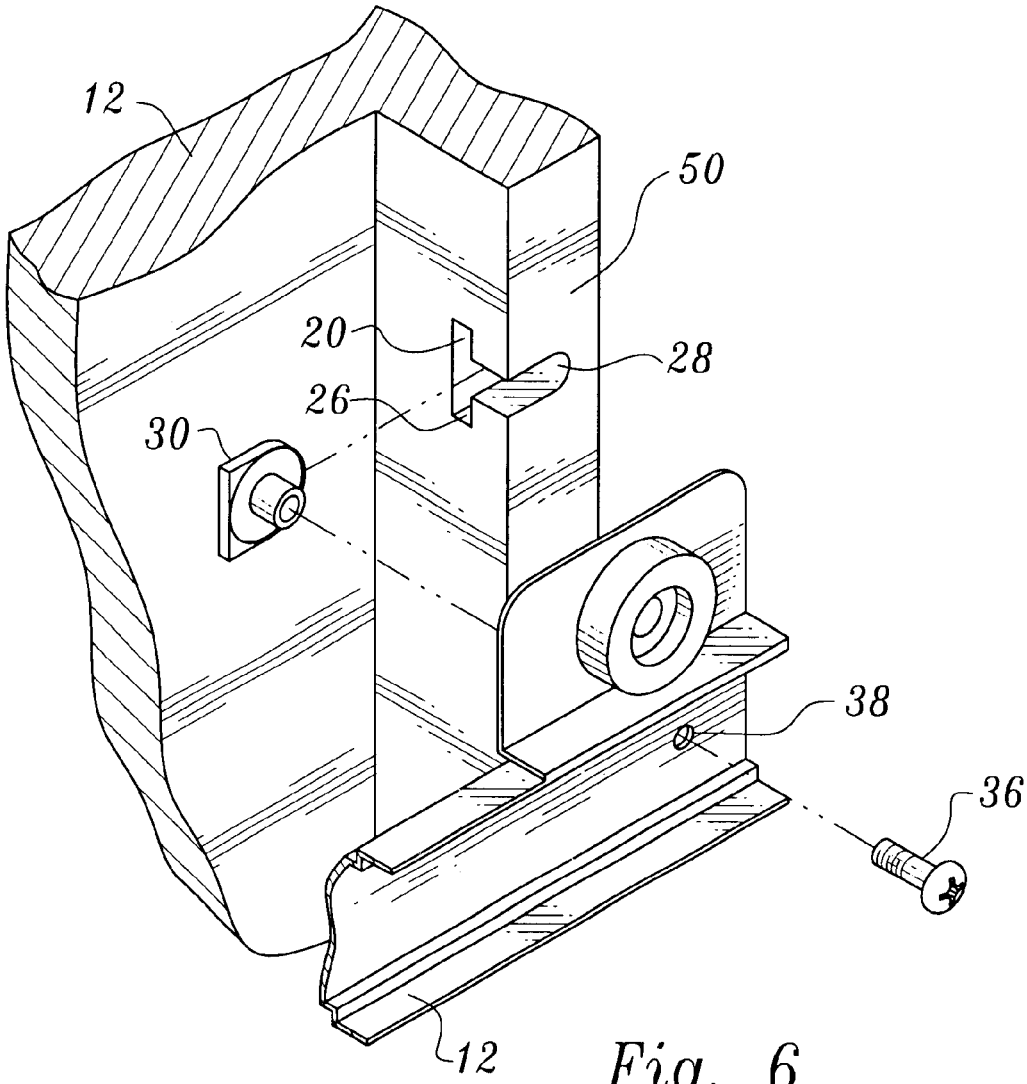
FIG. 6 is an exploded, perspective view illustrating a portion of the mounting bracket prior to attachment thereto to a frame member attached to a cabinet wall.

FIG. 6 shows another installation arrangement wherein a frame member 50 is attached to an end of cabinet wall 12. FIG. 6 shows the back or rear side of the frame member. A T-shaped opening 20 is formed at the back of the frame member with the recess 26 and slot 28 projecting into the frame member from the opening 20 toward the front of the frame. In this approach, the fastener member 30 is readily inserted into operating position from the back of the frame. The front of the frame will completely hide the opening, recess and slot as well as the fastener member.

In all of the embodiments described above, the use of wood screws to fasten mounting bracket 12 is avoided. This is important in furniture made from MDF and particle board, as typically ¾ inch composite material must be used to allow enough depth for a ½ inch screw to penetrate and hold mounting bracket 12 fast. Shorter screws in thinner composite materials tend to work loose, with the corresponding bracket, roller guide, and drawer working loose as well. The fastener arrangement disclosed herein allows bracket 12 to be mounted without working loose and additionally, allows for very thin composite materials to be used to build cabinets and other furniture. It has been found that fastener plate 32 can hold mounting bracket 12 fast in MDF having a ⅜ inch width.

The invention claimed is:

1. In combination:

A furniture structure having spaced, opposed structure surfaces, said furniture structure defining an opening, a recess communicating with said opening and located between said structure surfaces and a slot extending into said furniture structure from one of said structure surfaces, said slot communicating with said recess, extending therealong and having a vertical dimension less than the vertical dimension of said recess;

a drawer guide assembly extending along said furniture structure adjacent to one of said structure surfaces and including a mounting bracket positioned over said slot, said mounting bracket defining an aperture; and fastener means fastening said mounting bracket to said furniture structure, said fastener means comprising a threaded member extending through the aperture of said mounting bracket and into said slot and a fastener member disposed in said recess and threadedly engaging said threaded member, a portion of said furniture structure adjoining said slot clampingly engaged between said mounting bracket and said fastener member.

2. The combination according to claim 1 wherein said fastener member includes a fastener plate bearing against said portion of said furniture structure and a threaded boss projecting from said fastener plate into said slot.

3. The combination according to claim 2 wherein said plate includes a rib spaced from said threaded boss engaging said portion of said furniture structure.

4. The combination according to claim 2 wherein said furniture structure comprises a cabinet wall having a cabinet wall end, said opening being formed in said cabinet wall end and said recess projecting into said cabinet wall from said opening and from said cabinet wall end.

5. The combination according to claim 4 wherein said slot extends inwardly from said cabinet wall end from said opening and communicates with said opening.

6. The combination according to claim 5 wherein said opening has a T-shaped configuration and has a generally vertically oriented opening component and a generally horizontally oriented opening component, said recess extending from and communicating with said generally vertically oriented opening component and said slot extending from and communicating with said generally horizontally oriented opening component, said generally vertically oriented opening component allowing selective entry of said fastener plate into said recess or exit of said fastener plate from said recess, and said generally horizontally oriented opening component allowing selective entry of said threaded boss into said slot or exit of said threaded boss from said slot.

7. The combination according to claim 2 wherein said furniture structure comprises a cabinet wall and a frame member attached to said cabinet wall, said opening being formed in said frame member and said recess projecting into said frame member.

8. The combination according to claim 7 wherein said slot extends inwardly into said frame member from said opening and communicates with said opening.

9. The combination according to claim 8 wherein said opening has a T-shaped configuration and has a generally vertically oriented opening component and a generally horizontally oriented opening component, said recess extending from and communicating with said generally vertically oriented opening component and said slot extending from and communicating with said generally horizontally oriented opening component, said generally horizontally oriented opening component allowing selective entry of said fastener plate into said recess or exit of said fastener plate from said recess, and said generally horizontally oriented opening component allowing selective entry of said threaded boss into said slot or exit of said threaded boss from said slot.

10. The combination according to claim 2 wherein said furniture structure comprises a cabinet wall having a cabinet wall end, said opening being formed in one of said structure surfaces at a location spaced from said cabinet wall end.

11. The combination according to claim 10 wherein said slot extends along and is formed in the structure surface in which said opening is formed and communicates with said opening.

12. The combination according to claim 11 wherein said opening is sufficiently large to allow passage therethrough of said fastener member.

13. The combination according to claim 1 wherein said furniture structure defines a second opening, a second recess communicating with said second opening and located between said structure surfaces and a second slot extending into said furniture structure from one of said structure surfaces, said second slot communicating with said second recess, extending therealong and having a vertical dimension less than the vertical dimension of said second recess, said mounting bracket extending between said opening and said second opening.

14. The combination according to claim 13 additionally comprising second fastener means fastening said mounting bracket to said furniture structure at the location of said second slot.

15. The combination according to claim 13 wherein said furniture structure comprises a cabinet wall having two cabinet wall ends spaced from one another, said opening and said second opening being formed in different cabinet wall ends.

* * * * *